US006283210B1

(12) United States Patent
Soliman et al.

(10) Patent No.: US 6,283,210 B1
(45) Date of Patent: Sep. 4, 2001

(54) PROACTIVE CONFORMANCE FOR OIL OR GAS WELLS

(75) Inventors: Mohamed Yousef Soliman, Plano; Prentice G. Creel, Odessa; Steve Rester, Houston; Michael H. Johnson, Flower Mound; Loyd E. East, Jr., Duncan; Don M. Everett, Houston, all of TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/387,476

(22) Filed: Sep. 1, 1999

(51) Int. Cl.[7] ..... E21B 33/138
(52) U.S. Cl. ..... 166/270; 166/270.1; 166/300
(58) Field of Search ..... 166/272.3, 272.6, 166/306, 295, 300, 270, 270.1, 270.2

(56) References Cited

U.S. PATENT DOCUMENTS 3,289,072 * 11/1966 Schuster ..... 324/303
3,456,183 * 7/1969 Codrington et al. ..... 324/303
3,528,000 * 9/1970 Schwede ..... 324/303
4,022,276 * 5/1977 Dreher et al. ..... 166/250
4,031,958 * 6/1977 Sandiford et al. ..... 166/270
4,693,310 * 9/1987 Gibbons ..... 166/270
4,947,935 * 8/1990 Sydansk ..... 166/295
4,995,461 * 2/1991 Sydansk ..... 166/295
5,350,014 * 9/1994 McKay ..... 166/263
6,016,869 * 1/2000 Bursts, Jr. ..... 166/295

OTHER PUBLICATIONS

G. W. Gunter et al.. "Early Determination of Reservoir Flow Units Using an Integrated Petrophysical Method," SPE 38679 (1997 Society of Petroleum Engineers Annual Technical Conference and Exhibition, Oct. 5–8, 1997).

* cited by examiner

*Primary Examiner*—Frank S. Tsay
(74) *Attorney, Agent, or Firm*—Robert A. Kent; E. Harry Gilbert, III

(57) ABSTRACT

A proactive conformance method for a well includes selecting a well either in a completion phase or early in a production phase of the well and performing a conformance treatment on the well in the completion phase or early in the production phase. The conformance treatment preferably is performed before the well is completed (i.e., sometime during the completion phase between the well having been drilled and the well being placed in production), such as after running open hole logging or before setting casing. Another preferred aspect is the use of magnetic resonance imaging, such as using magnetic resonance imaging to analyze the well to determine where unwanted mobile fluid is in a reservoir intersected by the well. Such a well is completed in response to using the magnetic resonance imaging, including treating the well to confine at least part of the unwanted mobile fluid determined to be in the reservoir.

14 Claims, 1 Drawing Sheet

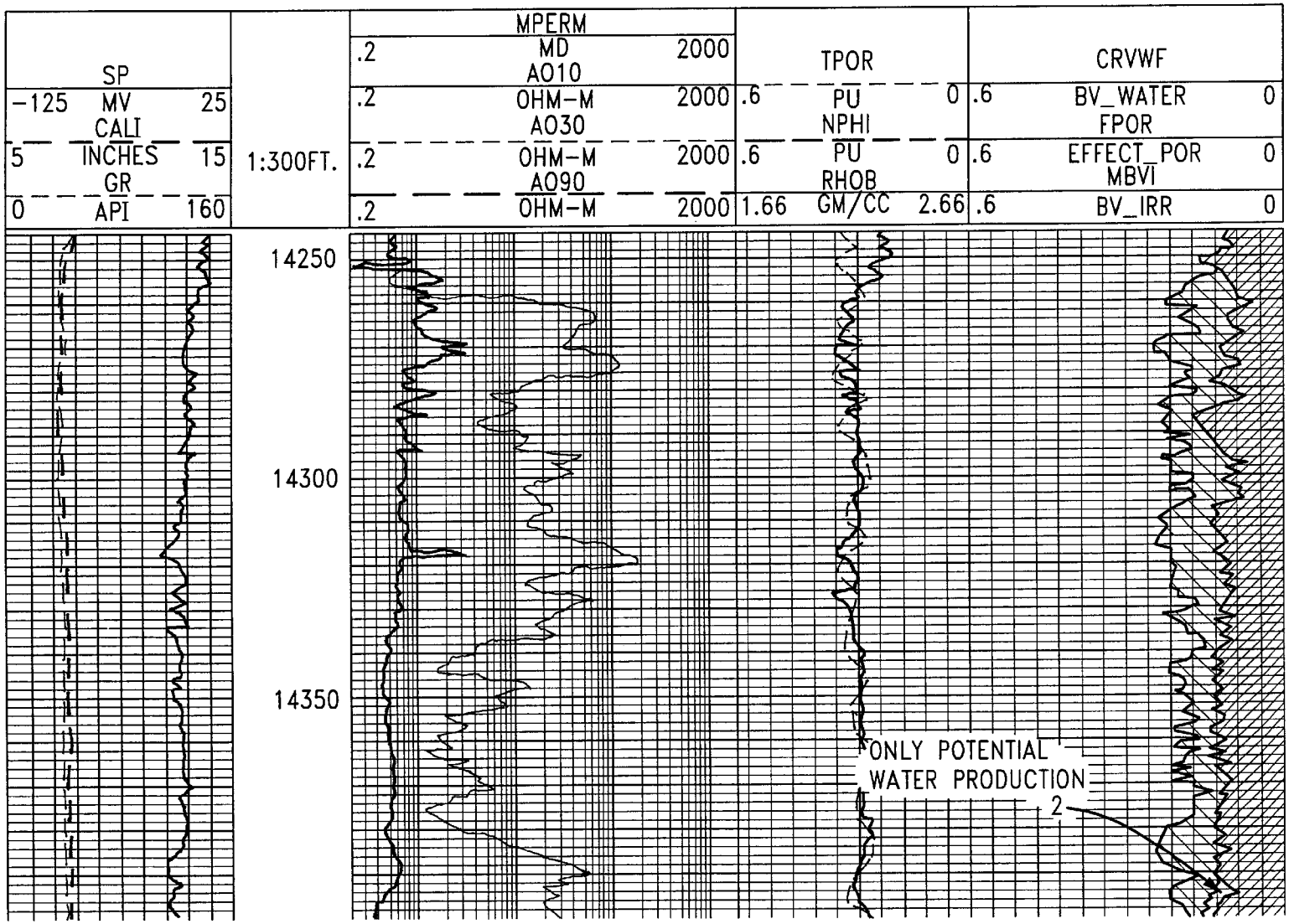
SP
-125 MV 25
CALI
5 INCHES 15
GR
0 API 160
1:300FT.
MPERM
MD
.2 AO10 2000
OHM-M
.2 AO30 2000
OHM-M
.2 AO90 2000
OHM-M
.2 2000
TPOR
.6 PU 0
NPHI
.6 PU 0
RHOB
1.66 GM/CC 2.66
CRVWF
.6 BV_WATER 0
FPOR
.6 EFFECT_POR 0
MBVI
.6 BV_IRR 0
14250
14300
14350
ONLY POTENTIAL
WATER PRODUCTION
2

PROACTIVE CONFORMANCE FOR OIL OR GAS WELLS

BACKGROUND OF THE INVENTION

This invention relates generally to conformance methods for oil or gas wells and particularly to early stage proactive conformance rather than late stage reactive conformance.

Liquid and gaseous hydrocarbons are extracted from the earth through wells that penetrate into or through hydrocarbon-bearing formations or reservoirs. Techniques for creating and using such wells are well-known. For a production well, such techniques are used during drilling, completing, and producing phases.

Drilling pertains to forming a borehole in the earth. Completing pertains to making the hole ready to allow desired hydrocarbons to flow up through it. Producing pertains to controlling and maintaining this flow.

There can be other fluids in the reservoir. Pertinent examples include water and unwanted gas. Amounts of these unwanted fluids relative to desired hydrocarbons and their locations relative to the reservoir can change over time (for example, by coning or channeling). When this occurs, one response is to provide a conformance treatment. In general, conformance is the management of unwanted water and gas in a well/reservoir.

Conformance treatments have been used near the end of, or otherwise late in, the production phase because that is when the adverse impact of unwanted water or gas has been most noticed (for example, a relatively large amount of water or unwanted gas begins to be produced). Although such late stage, or reactive, conformance treatment can be useful, it may be too late to reverse some or all detrimental reservoir conditions that may have resulted from the unwanted water or gas flow. These detrimental results may negatively affect the reservoir ultimate recovery factor.

SUMMARY OF THE INVENTION

The present invention overcomes the above-noted and other shortcomings of the prior art by providing novel and improved proactive conformance. In a particular implementation, such conformance is part of a completion method for a given well. The present invention is used proactively to seek enhancement of production from the beginning of the useful life of the well. The present invention may also be described as preventative in that its early proactive use may avoid reservoir damage that might occur if conformance were left to typical late stage implementation.

A proactive conformance treatment method may be significantly more effective and also more economical to apply than a reactive treatment. This can be by way of, for example, delaying potential water production whereby higher desired hydrocarbon production occurs without risking early water breakthrough. The present invention may lead to higher hydrocarbon production, larger ultimate recovery factor and lower production of unwanted water.

The present invention can be defined as a proactive conformance method for a well, comprising: selecting a well either in a completion phase or early in a production phase of the well; and performing a conformance treatment on the well in the completion phase or early in the production phase. Preferably, the conformance treatment is performed before the well is completed (i.e., sometime during the completion phase between the well having been drilled and the well being placed in production). More specifically within the completion phase, the conformance treatment can be performed after running open hole logging or before setting casing, for example. In at least such latter implementation the present invention provides a method of completing a well comprising: performing a conformance treatment on an open bore of the well; and casing at least a portion of the conformance treated bore.

Another preferred aspect of the present invention is the use of magnetic resonance imaging. With regard to this aspect, the present invention can be defined as a method of completing a well, comprising: using magnetic resonance imaging to analyze the well to determine where unwanted mobile fluid is in a reservoir intersected by the well; and completing the well in response to using magnetic resonance imaging, including treating the well to confine at least part of the unwanted mobile fluid determined to be in the reservoir. In a preferred implementation of the proactive conformance method of the present invention, the method further comprises using magnetic resonance imaging in the well prior to performing the conformance treatment, and performing the conformance treatment in response to using the magnetic resonance imaging.

Therefore, from the foregoing, it is a general object of the present invention to provide novel and improved proactive conformance. Other and further objects, features and advantages of the present invention will be readily apparent to those skilled in the art when the following description of the preferred embodiments is read in conjunction with the accompanying drawing.

BRIEF DESCRIPTION OF THE DRAWING

The drawing depicts a log provided from a magnetic resonance imaging logging tool.

DETAILED DESCRIPTION OF THE INVENTION

In the proactive conformance method of the present invention, a well is selected for receiving a conformance treatment. Selection occurs no later than either during the completion phase or early in the production phase of the respective well. As to the latter, selection is preferably before the well has started producing large amounts of unwanted water or gas The term "large amounts" is a relative term that may vary from one reservoir to another and may also depend on tolerance of an operator to water production and unwanted gas. This tolerance may depend on the environmental concerns, and how to dispose of water, and may also depend on where the rig is located (e.g., onshore versus off-shore, North Sea operation versus mainland China). The preferred scenario is to perform the proactive conformance treatment before commercial and significant production of hydrocarbon has taken place.

It is more preferred that the well be selected before it has been completed, and it is particularly preferred to do it before the casing has been set to avoid having the casing restrict free access to the formation. If the selection occurs after completion, some of the completion work may have to be redone (e.g., reperforated and sealed using one of the various chemical and/or mechanical techniques such as a cement squeeze treatment). Most preferably, the selection occurs such that considerations pertinent to designing a conformance treatment can be integrated with other completion decisions. For example, pertinent logging information can be obtained.

Selecting a particular well includes determining whether it is a candidate for conformance. This can include, once appropriate reservoir parameters are known, using qualitative analysis, experience, etc. or using a quantitative analysis such as reservoir simulation to predict potential problems and whether conformance might be an appropriate remedy. Reservoir simulation may range in scope from simple analytical solutions to sophisticated multi-well multi-phase numerical simulations. Some of this information, such as the presence of multiple fluids and whether these fluids are mobile, presently may be accurately obtained only through the use of magnetic resonance imaging. Other techniques may give estimates of those values, however, not with the accuracy of magnetic resonance imaging and sometimes possibly not even as a meaningful estimate. Non-limiting examples of characteristics indicating candidacy for conformance and thus selectability in the present invention include presence of a water aquifer, presence of a gas cap, presence of a high permeability or "super k" zone, and presence of fractures that would have to be plugged.

Diagnostic techniques play an important role in defining the problem and the appropriate solution. In proactive conformance the diagnostic technique defines the potential problem and the appropriate solution.

In general, logging that provides reservoir properties (e.g., permeability, porosity, grain size distribution, fluid saturation and irreducible saturation) is useful in the present invention. In a particular implementation, however, especially significant information includes the type and location of reservoir fluids, and specifically, whether the fluids include unwanted mobile water or gas. A tool that can provide this information is a magnetic resonance imaging logging tool such as of a type known in the art (one example is the MRIL tool from Halliburton Energy Services). Accordingly, a particular implementation of the present invention includes using magnetic resonance imaging, preferably during logging in an open bore of the well, to analyze the well to determine where unwanted mobile fluid is in a reservoir intersected by the well. This preferably occurs prior to performing a conformance treatment on the well so that the treatment, when performed, can be performed in response to the use of magnetic resonance imaging.

A magnetic resonance imaging logging tool is an open-hole logging tool that operates on known magnetic resonance imaging principles which include obtaining a response from the naturally abundant hydrogen protons in the formation fluids such as water, oil and gas. Information available or obtainable from a magnetic resonance imaging log includes lithology independent total porosity, irreducible water saturation (which indicates rock texture), water-cut prediction (when integrated with conventional open-hole logs), permeability (by combining the porosity, free fluid and bound fluid predictions), and fluid (oil, water, or gas) quantification. These properties lead to a better definition of fluid and rock properties, which in turn leads to a better understanding of the reservoir. Thus, using magnetic resonance imaging at the early stage of the present invention may significantly enhance the success of the well completion in general, the conformance treatment in particular, and ultimately the productivity of the well.

Other types of logs useful in analyzing a reservoir include resistivity, gamma ray, neutron density, sonic and caliper logs. When a suite of logs including these, or at least the first three, and a magnetic resonance imaging log are run in the well bore, information about formation layers, water presence and water mobility can be obtained. Magnetic resonance imaging is particularly useful in determining the water presence and mobility.

Magnetic resonance imaging may, also, be used to calculate formation permeability. This formation permeability can be used to create an integrated petrophysical reservoir model such as described by G. W. Gunter et al. in "Early Determination of Reservoir Flow Units Using an Integrated Petrophysical Method," SPE 38679 (1997 Society of Petroleum Engineers Annual Technical Conference and Exhibition, Oct. 5–8, 1997); in that technique, a modified form of Lorenz graph is used to characterize the formation. If used in the present invention, such a graph and reservoir model are created early in the life of the well. These facilitate diagnosis of possible problems with the reservoir and subsequent design of further completion activities (e.g., conformance, selective perforation, cementing, etc.). In the present invention, such diagnosis follows magnetic resonance imaging logging.

From the foregoing, magnetic resonance imaging logging enables improved accuracy in diagnosis that can be comparable to analyses that use data available only much later in the life of the reservoir.

The method of the present invention further comprises performing a conformance treatment on the well in the early stage of the anticipated life of the well. The treatment is preferably to confine at least part of the detected unwanted mobile fluid, and it is performed in response to the results of the magnetic resonance imaging logging when that logging is used (e.g., in response to the types and locations of fluids and the determined reservoir properties obtained using magnetic resonance imaging logging). When this is performed during the completion phase, it is preferably after running open hole logging as described above and before setting casing in the bore so that the treatment is performed on the open bore of the well in this preferred use of the present invention.

Conformance typically includes pumping in chemicals (e.g., water and polymers that crosslink in the well to form a plugging substance) to reduce or even eliminate unwanted fluid production. This may include plugging a high permeability zone or a fracture that could cause premature water breakthrough, or reducing the relative permeability to water while maintaining the relative permeability to oil. It may also include a complete plugging of a water zone to prevent future and potential water migration in a micro annulus that could form after a cementing treatment. Other applications may include creating a horizontal barrier to prevent vertical migration of unwanted fluids.

After the conformance treatment, the well is completed if completion has not already been finished. This can include casing at least a portion of the conformance treated well bore. Further completion work can include perforating, for example, performed conventionally but as designed based on the analysis work described above. Such further completion work can be performed as known in the art but as may be designed in accordance with information obtained through preceding steps of the method of the present invention.

As a non-limiting example of a conformance treatment and subsequent completion work, reference is now made to the drawing in which mobile water is identifiable from the magnetic resonance imaging log at the region marked with the reference number 2. This log shows that layers are mostly non-communicating with some containing water and others containing oil, which makes the formation a good candidate for treatment with a relative permeability modifier. The conformance treatment and remainder of the completion phase can be performed in accordance with where the potential water production region is identified. In this example, the relative permeability modifier can be injected at the zone carrying the mobile water to prevent or reduce water movement. Perforating can then be performed such as in the region of 14,250 feet to 14,375 feet. This combination of conformance treatment and perforation retard future water movement.

Other conformance treatments and completion techniques can of course be used. These typically are chemical, mechanical, or a combination of the two. Particular non-limiting examples include cement squeezes and spots, tool applications, polymer chemical systems, colloidal dispersed systems, sodium silicate chemical systems, foam cementing, in-situ polymerizing polyacrylamides, in-situ polymerizing acrylates, preformed and in-situ formed relative permeability modifiers, plug-backs with cement-sand mixtures-hydromites-etc., and other solution materials or techniques.

Once the well is completed, commercial production from the well can be initiated; therefore, the invention can be defined also to include initiating commercial production from the well only after performing the conformance treatment. By so performing the conformance treatment at an early stage, subsequent detrimental fluid flows may be prevented or delayed in such a manner as to improve production of desired hydrocarbons from the beginning of commercial production and to delay premature decline of production due to unwanted water or gas flow, for example.

As a result of the present invention, potential water production can be delayed such that higher hydrocarbon production can be obtained without risking early water breakthrough. Another result may be significant reduction of potential unwanted water and gas movement in well bore micro-annuli. The use of magnetic resonance imaging can facilitate the design of proactive conformance treatments, such as by identifying zones capable of producing water-free hydrocarbons, by identifying types and locations of formation fluids, and by identifying volumes of free fluids (water and hydrocarbons). Use of the present invention can also enhance achieving success with traditional treatments, both technically and commercially.

In the foregoing, the specific selection and use of particular diagnostic tools, the analysis of resulting data, the design of specific conformance treatments, and the further completion of a well and production from the well can individually be performed as known in the art. Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A proactive conformance method for a well intersecting a reservoir containing hydrocarbons and water, comprising:

during a completion phase occurring after drilling the well, but before finishing the completion phase of the well, determining potential water and gas production including running open hole logging to obtain reservoir information, including at least one of permeability, porosity, grain size distribution, fluid saturation and irreducible saturation, type and location of reservoir fluids, and unwanted mobile water or gas, and using the obtained reservoir information to determine whether the reservoir includes at least one of a water aquifer, gas cap, high permeability or super k zone, or fractures that need to be plugged;

selecting an appropriate conformance treatment for the well in response to the determined potential water and gas production; and applying the selected conformance treatment to the open bore of the well and thereafter finishing the completion of the well, including cementing casing in the well, so that a production profile that otherwise would later occur during a production phase of the well is changed to obtain from the beginning of the useful life of the well enhanced production including at least one of higher hydrocarbon production, larger ultimate recovery factor and lower production of unwanted water.

2. A proactive conformance method as defined in claim 1, wherein determining potential water and gas production includes using magnetic resonance imaging during logging in the open bore of the well for use in determining where unwanted mobile fluid is in the reservoir.

3. A proactive conformance method as defined in claim 1, wherein determining potential water and gas production includes logging to obtain at least one of a resistivity log, a gamma ray log, a neutron density log, a sonic log, or a caliper log.

4. A proactive conformance method as defined in claim 1, wherein determining potential water and gas production includes obtaining a suite of logs including a resistivity log, a gamma ray log, a neutron density log, and a magnetic resonance imaging log from which to provide information about formation layers, water presence and water mobility in the reservoir.

5. A proactive conformance method as defined in claim 1, wherein selecting an appropriate conformance treatment includes using at least one of a graphical or a modeling diagnostic.

6. A proactive conformance method for a well intersecting a reservoir containing hydrocarbons and water, comprising:

during a completion phase occurring after drilling the well, but before finishing the completion phase of the well, determining potential water and gas production including running open hole logging to obtain reservoir information, including at least one of permeability, porosity, grain size distribution, fluid saturation and irreducible saturation, type and location of reservoir fluids, and unwanted mobile water or gas, and using the obtained reservoir information to determine whether the reservoir includes at least one of a water aquifer, gas cap, high permeability or super k zone, or fractures that need to be plugged;

selecting an appropriate conformance treatment for the well in response to the determined potential water and gas production; and applying the selected conformance treatment to the open bore of the well and thereafter finishing the completion of the well so that a production profile that otherwise would later occur during a production phase of the well is changed to obtain from the beginning of the useful life of the well enhanced production, including performing at least one of pumping chemicals to reduce or eliminate unwanted fluid production, plugging a high permeability zone or a fracture permitting premature water breakthrough, reducing the relative permeability to water while maintaining the relative permeability to oil, plugging a water zone to prevent future and potential water migration in a micro annulus formed after cementing the casing, creating a horizontal barrier to prevent vertical migration of unwanted fluids, or applying in the well at least one of cement squeezes and spots, tool applications, polymer chemical systems, colloidal dispersed systems, sodium silicate chemical systems, foam cementing, in-situ polymerizing polyacrylamides, in-situ polymerizing acrylates, preformed and in-situ formed relative permeability modifiers, or plug-backs with cement-sand mixtures-hydromites.

7. A proactive conformance method as defined in claim 6, wherein determining potential water and gas production includes using magnetic resonance imaging during logging in the open bore of the well for use in determining where unwanted mobile fluid is in the reservoir.

8. A proactive conformance method as defined in claim 6, wherein determining potential water and gas production includes logging to obtain at least one of a resistivity log, a gamma ray log, a neutron density log, a sonic log, or a caliper log.

9. A proactive conformance method as defined in claim 6, wherein determining potential water and gas production includes obtaining a suite of logs including a resistivity log, a gamma ray log, a neutron density log, and a magnetic resonance imaging log from which to provide information about formation layers, water presence and water mobility in the reservoir.

10. A proactive conformance method as defined in claim 6, wherein selecting an appropriate conformance treatment includes using at least one of a graphical or a modeling diagnostic.

11. A proactive conformance method for a well intersecting a reservoir containing hydrocarbons and water, comprising:

during a completion phase occurring after drilling the well, but before finishing the completion phase of the well, determining potential water and gas production including running open hole logging to obtain reservoir information, including at least one of permeability, porosity, grain size distribution, fluid saturation and irreducible saturation, type and location of reservoir fluids, and unwanted mobile water or gas, and performing at least one of a qualitative analysis or a quantitative analysis using the obtained reservoir information to determine whether the reservoir includes at least one of a water aquifer, gas cap, high permeability or super k zone, or fractures that need to be plugged;

selecting an appropriate conformance treatment for the well in response to the determined potential water and gas production, including using at least one of a graphical or a modeling diagnostic; and applying the selected conformance treatment to the open bore of the well and thereafter finishing the completion of the well, including cementing casing in the well, so that a production profile that otherwise would later occur during a production phase of the well is changed to obtain from the beginning of the useful life of the well enhanced production including higher hydrocarbon production, larger ultimate recovery factor and lower production of unwanted water, including performing at least one of pumping chemicals to reduce or eliminate unwanted fluid production, plugging a high permeability zone or a fracture permitting premature water breakthrough, reducing the relative permeability to water while maintaining the relative permeability to oil, plugging a water zone to prevent future and potential water migration in a micro annulus formed after cementing the casing, creating a horizontal barrier to prevent vertical migration of unwanted fluids, or applying in the well at least one of cement squeezes and spots, tool applications, polymer chemical systems, colloidal dispersed systems, sodium silicate chemical systems, foam cementing, in-situ polymerizing polyacrylamides, in-situ polymerizing acrylates, preformed and in-situ formed relative permeability modifiers, or plug-backs with cement-sand mixtures-hydromites.

12. A proactive conformance method as defined in claim 11, wherein determining potential water and gas production includes using magnetic resonance imaging during logging in the open bore of the well for use in determining where unwanted mobile fluid is in the reservoir.

13. A proactive conformance method as defined in claim 11, wherein determining potential water and gas production includes logging to obtain at least one of a resistivity log, a gamma ray log, a neutron density log, a sonic log, or a caliper log.

14. A proactive conformance method as defined in claim 11, wherein determining potential water and gas production includes obtaining a suite of logs including a resistivity log, a gamma ray log, a neutron density log, and a magnetic resonance imaging log from which to provide information about formation layers, water presence and water mobility in the reservoir.

* * * * *